US005662183A

United States Patent [19]

Fang

[11] Patent Number: 5,662,183

[45] Date of Patent: Sep. 2, 1997

[54] HIGH STRENGTH MATRIX MATERIAL FOR PDC DRAG BITS

[75] Inventor: Zhigang Fang, The Woodlands, Tex.

[73] Assignee: Smith International, Inc., Houston, Tex.

[21] Appl. No.: 515,304

[22] Filed: Aug. 15, 1995

[51] Int. Cl.[6] ..... E21B 10/08

[52] U.S. Cl. ..... 175/374; 76/108.1

[58] Field of Search ..... 175/331, 374, 175/426, 435; 76/108.1

[56] References Cited

U.S. PATENT DOCUMENTS

| | | | |
|---|---|---|---|
| 4,276,788 | 7/1981 | van Nederveen | 175/374 X |
| 4,368,788 | 1/1983 | Drake | 175/374 |
| 4,372,404 | 2/1983 | Drake | 175/374 |
| 4,398,952 | 8/1983 | Drake | 419/18 |
| 4,588,608 | 5/1986 | Jackson et al. | 427/34 |
| 4,626,476 | 12/1986 | Londry et al. | 428/457 |
| 4,626,477 | 12/1986 | Jackson et al. | 428/457 |
| 4,884,477 | 12/1989 | Smith et al. | 76/108 A |
| 5,279,374 | 1/1994 | Sievers et al. | 175/374 |
| 5,348,770 | 9/1994 | Sievers et al. | 175/374 X |

OTHER PUBLICATIONS

D.E. Pearce, M.S. Nixon, and L.J. Wercholuk, CADE/CADDC Spring Drilling Conference, Powder Metal Cutter (PMC™) Technology Demonstrates Proven Performance in 200mm Bits in Canada, Paper No. 95–304, Apr. 19–21, 1995.

Randall M. German, Powder Injection Molding, 1990.

Dieter Bruschek and David Darrigo, "Ultra-Hard Wear Parts," The Carbide and Tool Journal, Mar.–Apr. 1996, pp. 14–15.

Metals Handbook vol. 1 Properties and Selection of Metals 8th ed; Published by American Society For Metals in Novelty, Ohio 1961; Bornemann, Alred et al. p. 659.

*Primary Examiner*—William P. Neuder

[57] ABSTRACT

A PDC drag bit body is disclosed which utilizes a high-strength infiltration binder having a composition comprising a nickel, cobalt, or iron base alloy. The infiltration molding process is modified to account for the higher melting temperatures of these alloys by using graphite plugs in the mold instead of actual PDC inserts, and after the PDC drag bit body has been fabricated and cooled, removing the graphite plugs and brazing the actual PDC inserts in the cavities left by the plugs. Further, the mold is coated with hexagonal-structure boron nitride to prevent the nickel, cobalt, or iron from attacking the graphite molds.

28 Claims, 3 Drawing Sheets

HIGH STRENGTH MATRIX MATERIAL FOR PDC DRAG BITS

BACKGROUND OF THE INVENTION

This invention relates to rock drill bits and the materials used to fabricate them.

Earth boring drill bit bodies utilizing polycrystalline diamond compact (PDC) inserts are well known in the art. These PDC bit bodies are fabricated from either steel or a hard metal "matrix" material. The matrix material is typically a composite of macro-crystalline or cast tungsten carbide infiltrated with a copper binder alloy. However, these drill bit bodies encounter significant problems when drilling in certain earth formations. The steel bodies, for example, do not possess enough erosion resistance critical to many drilling applications. The matrix body, on the other hand, has a high erosion resistance, but its impact resistance is low, and its potential use may be limited.

Earth boring drill bit bodies are also manufactured by sintering, a process unique from infiltration. The sintering process involves the introduction of a refractory compound into a mold. The refractory compound is usually a carbide of tungsten, titanium or tantalum, with some occasional specialized use made of the carbides of columbium, molybdenum, vanadium, chromium, zirconium and hafnium. Before the carbide is introduced into the mold, it is mixed with a binder metal. The binder metal is usually cobalt, but iron and nickel are used infrequently. The percentage of cobalt typically ranges from three to fifteen percent. After the mixture of the refractory compound and binding metal is introduced into the mold, the combination is heated to a point just below the melting point of the binder metal, and bonds are formed between the binder metal and the carbide by diffusion bonding or by liquid phase material transport. Thus, sintering is the process of bonding adjacent metal powders by heating a preformed mixture.

Infiltration, on the other hand, involves the introduction of a refractory compound such as tungsten carbide, usually the carbides listed above, into a mold with an opening at its top. A slug or cubes of binder metal are then placed against the refractory compound at the opening. The mold, refractory compound and binder metal are placed into a furnace, and the binder metal is heated to its melting point. By capillary action and gravity, the molten metal from the slug infiltrates the refractory compound in the mold, thereby binding the refractory compound into a part. As stated above, the infiltration binder is typically a copper alloy. Specifically, the composition of the binder is copper alloyed with nickel, manganese, zinc, tin, or some combination thereof.

The copper infiltrated tungsten carbide drag bit body possesses high wear resistance and, because of the hardness of the carbide, high erosion resistance as compared to steel, but the strength of the composite is poor in terms of either the charpy impact strength test or the transverse rupture strength test. Examination of failed bit bodies reveals the failure occurs between the copper to carbide bond. Thus, the tungsten carbide bonded with the copper alloy has low strength properties because failure occurs at the connection between the copper and the carbide, not within the copper alloy. A conventional copper matrix bit in a charpy test breaks at approximately 30 inch pounds and has a transverse rupture strength of 100 ksi. Thus, the copper infiltrated tungsten carbide drag bit body has overcome the wear and erosion resistance problems of the steel earth-boring drill bit bodies, but it would be desirable to overcome the reduction in strength that occurs in the tungsten carbide bonded with a copper alloy. Though the increased wear and erosion resistance provides an increase in the life of the drag bit body, increasing the strength limitations of the copper infiltrated tungsten carbide drag bit bodies without reducing the wear and erosion resistance would lead to a reduction in the number of round trips of a drill string in a borehole and increase in the rate of penetration of bits into the rock formation. With a stronger bit body, higher weight may be applied to the bit to provide faster penetration.

Thus, increase in the strength of the PDC bit body, while maintaining wear and erosion resistance, is desirable to reduce round trips, enhance the rate of penetration for the drag bit, and increase the possible variety of body designs and insert configurations. Such increases in the versatility of designs and in the rate of penetration, and decrease in round trips, translate directly into a reduction in drilling expenses.

BRIEF SUMMARY OF THE INVENTION

To address such problems, there is provided in the practice of an embodiment of this invention a PDC drag bit body that has a composition including a refractory compound and an infiltration binder with at least one metal chosen from nickel, iron, or cobalt.

The invention is still further directed to a method of fabricating a PDC drag bit body including the steps of fabricating a mold, introducing a refractory compound into the mold, and infiltrating the refractory compound with an infiltration binder alloy with a composition of at least one metal chosen from nickel, iron, or cobalt.

These and other features and advantages will appear from the following description of the preferred embodiments and the accompanying drawings in which similar reference characters denote similar elements throughout the several views.

DETAILED DESCRIPTION

Figure 1:
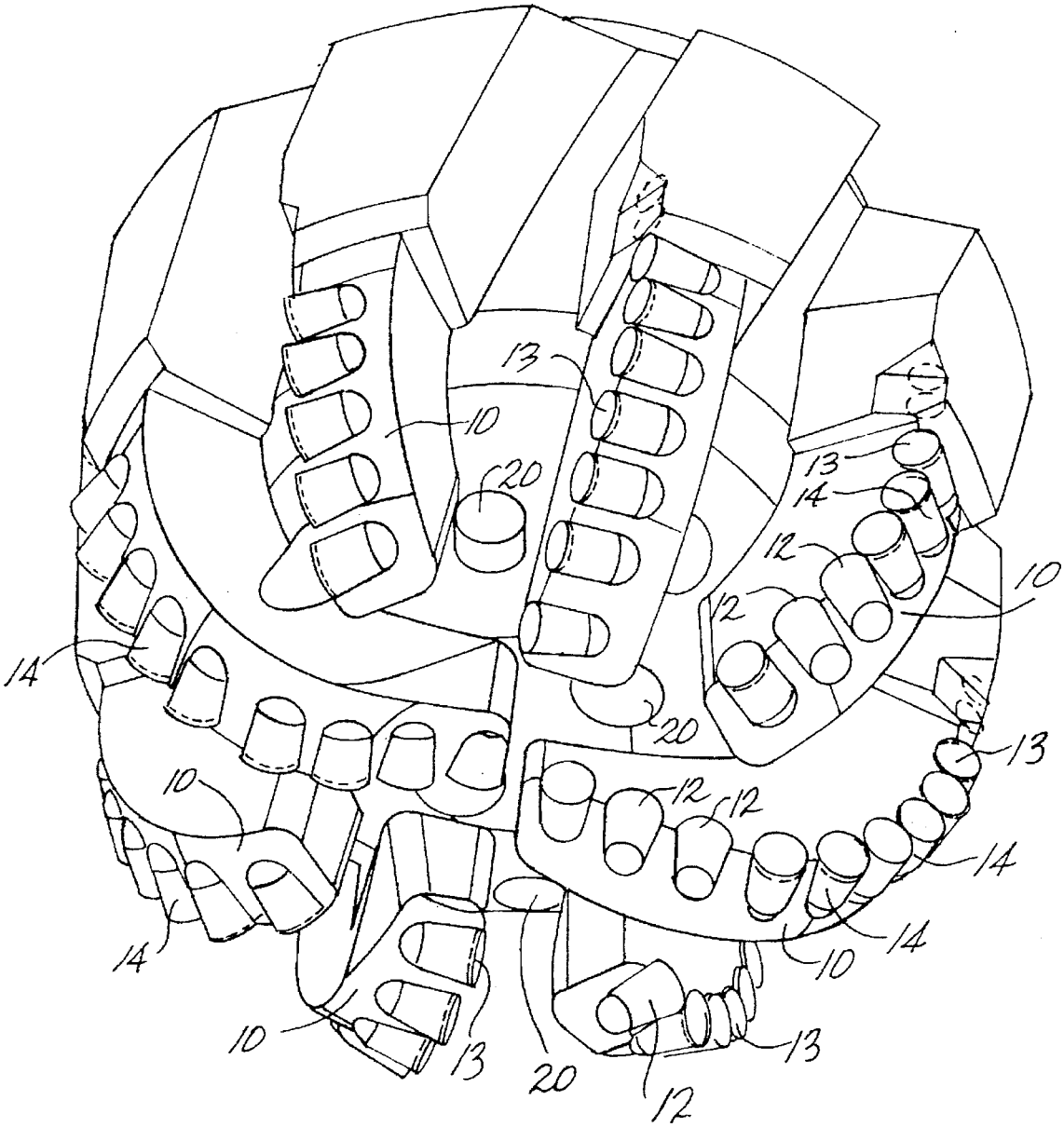
FIG. 1 is a perspective view, of an embodiment of an earth boring drill bit body with some inserts in place and employing an embodiment of the matrix material of the present invention.

An improved PDC drag bit body as shown in FIG. 1 may be employed with any type of earth-boring drag bit arrangement known in the art. In the embodiment of the invention illustrated in the drawing, a PDC drag bit body is formed with faces 10 at its lower end. A plurality of pockets 12 are formed in the faces to receive a plurality of conventional polycrystalline diamond compact (PDC) inserts 14. It would be recognized by those skilled in the art that the PDC insert body may be fabricated to support numerous other bit and insert arrangements, many of which are already known in the art.

The PDC drag bit bodies already known in the art are steel bodies or consist of a refractory compound and an infiltration binder. The binder is typically a copper alloy of nickel, manganese, zinc, tin or some combination thereof. The refractory compound is preferably the carbide of tungsten, specifically, a mixture of macrocrystalline carbide and cast carbide (WC and $W_2C$ respectively) which is available from Kennametal, Inc., Latrobe, Pa. Other carbides can be used for applications requiring different properties.

To overcome the low strength problems of the copper infiltrated tungsten carbide bodies outlined above, the copper infiltration binder alloy is replaced with an infiltration binder chosen from the transition metals. The preferred metals are cobalt, iron, and nickel. A preferred alloy has a composition of nickel alloyed with from 8 to 12% cobalt, 5 to 10% chromium, up to 3% aluminum and about 1% boron to lower the melting point. The nickel alloy may also contain up to 5% silicon, which is typical to the transition metals, and trace amounts of manganese, molybdenum, and iron are acceptable. Further, the alloy may contain up to 5% carbon, which adds strength to the binder when present in such a low amount that carbides are not formed. The nickel preferably comprises from 60 to 81% of the composition. The aluminum also strengthens the bit body. The aluminum provides solid solution strength. The binder may also include up to 25% refractory metal comprising titanium, zirconium, hafnium, vanadium, niobium, tantalum, chromium, molybdenum, tungsten, or some combination thereof. More than 25% refractory metal can be used, but is not preferred because it raises the melting point of the alloy too high.

The copper alloy currently used as an infiltration binder had a melting point of approximately 1,000° C. and nickel has a melting point of approximately 1,453° C. It is desirable, therefore, to alloy the nickel, to obtain a low enough melting point so that the infiltration process can be performed in a common vacuum furnace. If cobalt or iron is used as the infiltration binder, these metals are alloyed to a similar extent as nickel to reduce their melting temperatures, which can be higher than nickel alloys, so when referring to a cobalt, nickel, or iron alloy, the cobalt, nickel, or iron does not necessarily comprise a majority, that is, more than 50% of the alloy. The cobalt, nickel, or iron is, however, the dominant metal. That is, the metal comprising the greatest percentage of the total alloy.

The currently used copper alloy infiltration binder does not inhibit the increased wear and erosion resistance provided by the refractory compound, but there is a reduction in strength. Examination of failed copper samples reveals that the copper infiltrated samples fail at the connection between the copper infiltration binder and the carbide. In nickel samples, however, failure occurs in the form of cracks through the nickel, not through the nickel-tungsten carbide bonds. The difference in where the binders fail explains the increased strength of the nickel infiltration binder exhibited in charpy tests and transverse rupture strength tests and reveals that the nickel binder has an increased ability to wet the carbide.

Figure 2:
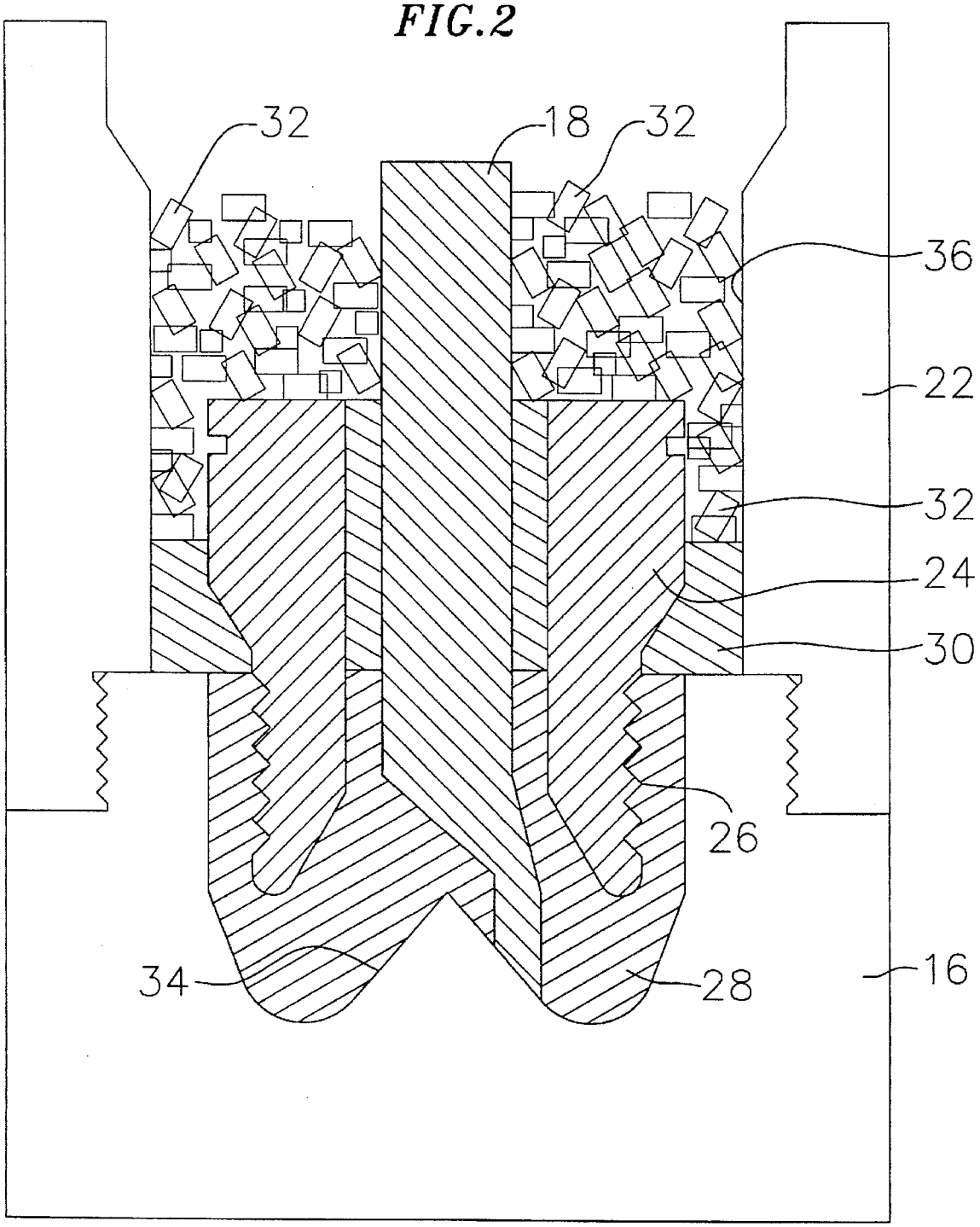
FIG. 2 is a cross-sectional schematic illustration of an embodiment of a mold and materials used to manufacture an earth boring drill bit body utilizing features of the present invention.

Referring to FIG. 2, the process utilizing the novel nickel alloy infiltration binder begins with the fabrication of a mold 16, preferably a graphite mold, having the desired bit body shape and insert configuration. Sand cores 18 form the fluid passages 20 (FIG. 1) in the bit body. A graphite funnel 22 is threaded onto the top of the mold, and a steel blank 24 with teeth 26 is suspended through the funnel and in the mold. The teeth provide a strong connection between the blank and the refractory compound 28 after infiltration. The refractory compound 28 is then introduced into the mold. After the refractory compound has settled, typically by vibration, a machinable and weldable material 30, preferably machinable tungsten powder, is introduced into the funnel. The machinable material provides, for example, a surface for machining threads whereby the bit body can be attached to a conventional drill string (not shown). A grip on the steel blank, now supported by the refractory compound and machinable material, can be released, and the binder alloy in the form of a slug or cubes 32 is introduced into the funnel on top of the steel blank and the machinable material. The mold, funnel, and materials contained therein are then placed in a vacuum or controlled atmosphere furnace and heated to the melting point of the infiltration binder. The binder then flows into and wets the machinable material and the refractory compound bonding the refractory compound together. The cooled product is removed from the mold and is ready for fabrication into the earth boring drill bit.

Some of the infiltration binders, including nickel, has good solubility for carbon at liquid state. Thus, the graphite mold can be subject to attack by the liquid binder. Therefore, the internal mold surface 34 and the internal funnel surface 36 are coated with a thin layer of hexagonal-structure boron nitride (HBN), which prevents the nickel from attacking the graphite mold and funnel.

Figure 3:
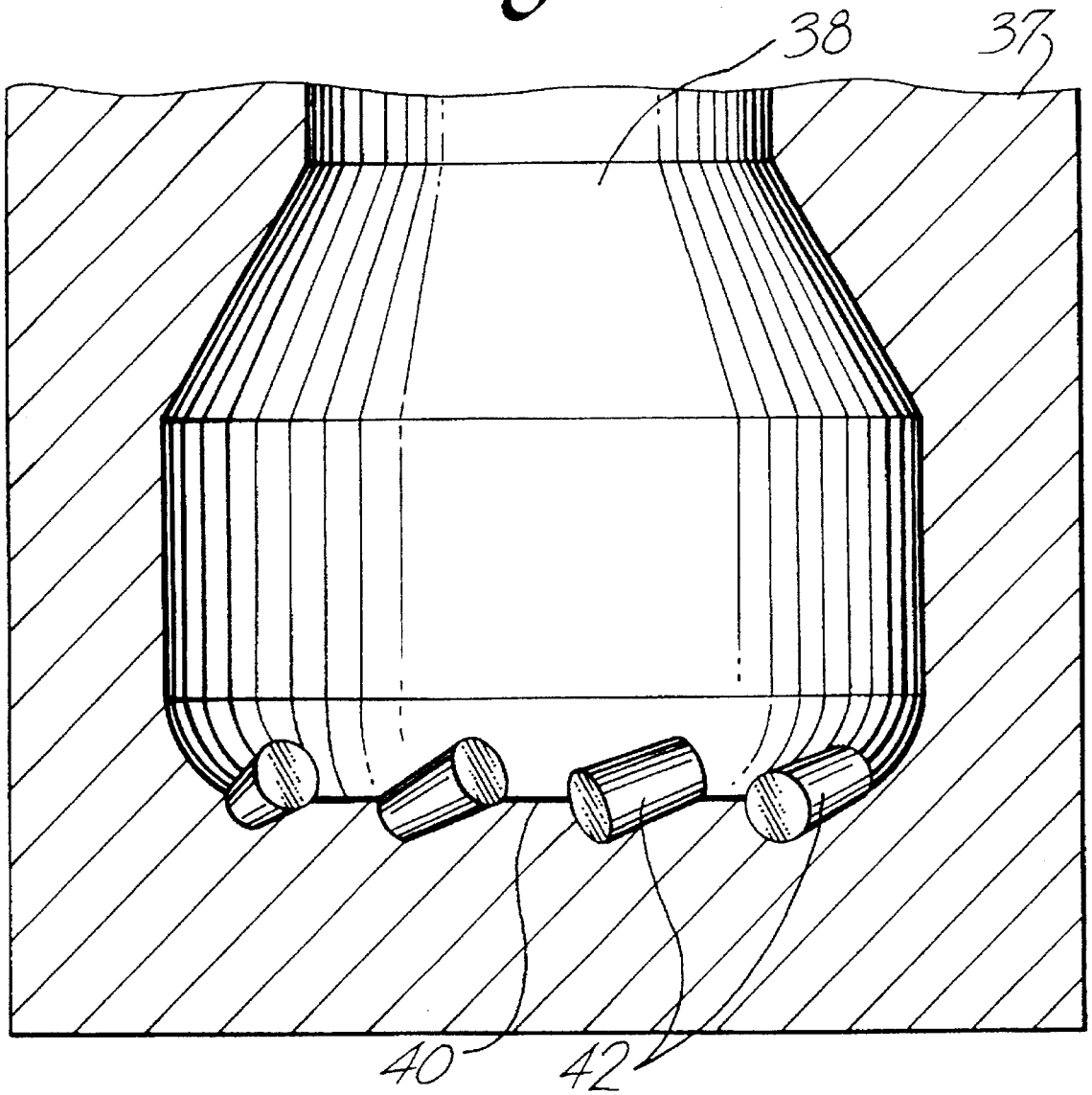
FIG. 3 is a cross-sectional schematic illustration of an embodiment of a mold with graphite plugs used to manufacture PDC drag bit bodies utilizing high melting point infiltration binders and having an alternate configuration of the inserts.

Another exemplary mold 37 illustrating the formation of the pockets 12 is shown in FIG. 3. The mold has a cavity 38 with a lower end 40. The lower end of the mold has graphite plugs 42. Because the nickel, cobalt and iron alloys binder have melting points well above the point at which diamond reverts back to graphite, the graphite plugs are placed in the mold to form the pockets into which the inserts 14 will be brazed after the drag bit body is fabricated. After the refractory compound has been infiltrated and the PDC bit body has cooled, the body is removed from the mold, and the graphite plugs are shattered with a sharp blow to effect their removal. The PDC inserts are then brazed into the pockets left by the plugs. The cylindrical inserts, which are conventional, are made from a hard material such as tungsten carbide and have polycrystalline diamond compacts covering the cutting face 13. Thus, the cutting face of the hard cylindrical body is covered with an even harder material, diamond. When the inserts are being brazed into the pockets, a back-up material 15 is built up directly behind the inserts to more securely hold the inserts in the pockets, and then the PDC drag bit body is complete.

The PDC drag bit body formed by this process contains approximately 40% by volume of the infiltration binder and 60% of the refractory compound, but more or less of each can be used with lower limits of 25% binder and 50% by volume refractory compound. If there is less than 25% binder the bit body starts to lose some of the desired strength provided by the nickel binder, and if there is less than 50% refractory compound, the wear resistance of the body starts to diminish. During solidification, the PDC bit body shrinkage is approximately 2%, which is a result of the solidification of the infiltration binder, but the molds are sized to compensate for the shrinkage. The resultant PDC drag bit body has the superior strength and toughness of the previous drag bit bodies formed with steel and the superior wear and erosion resistance of copper infiltrated carbides. Therefore, the PDC drag bit body according to the current invention provides the wear and erosion resistance characteristic of the refractory compound, and the strength, ductility, and toughness properties of nickel, cobalt, or iron, which are superior to the previously used copper alloy infiltration binder.

Thus, a PDC drag bit body is disclosed which utilizes a high-strength infiltration binder to increase the strength of PDC drag bit bodies, increase the versatility of bit designs, and increase the overall rate of penetration of PDC drag bits. While embodiments and applications of this invention have been shown and described, it would be apparent to those skilled in the art that many more modifications are possible without departing from the inventive concepts herein. It is, therefore, to be understood that within the scope of the appended claims, this invention may be practiced otherwise than as specifically described.

What is claimed is:

1. A PDC drag bit comprising a body having a face on a lower end of the body, a plurality of pockets in the face of the body, a plurality of inserts in the pockets, and the body including a refractory compound infiltrated with a binder composition, wherein the binder composition comprises at least 60% nickel and at least 8% cobalt.

2. The bit of claim 1 wherein the binder composition further comprises about 1% boron.

3. A PDC drag bit comprising a body having a face on a lower end of the body, a plurality of pockets in the face of the body, a plurality of inserts in the pockets, and the body including a refractory compound infiltrated with a binder composition, wherein the binder composition comprises from 60% to 81% nickel, from 8% to 12% cobalt, from 5% to 10% refractory metal chosen from the group consisting of titanium, zirconium, hafnium, vanadium, niobium, tantalum, chromium, molybdenum, and tungsten, and about 1% boron.

4. A PDC drag bit comprising a body having a face on a lower end of the body, a plurality of pockets in the face of the body, a plurality of inserts in the pockets, and the body including a refractory compound infiltrated with a binder composition, wherein the binder composition comprises from 6 chromium, and about 1% boron.

5. A PDC drag bit comprising a body having a face on a lower end of the body, a plurality of pockets in the face of the body, a plurality of inserts in the pockets, and the body including a refractory compound infiltrated with a binder composition, wherein the binder composition comprises from 60% to 81% nickel, from 8% to 12% cobalt, from 5% to 10% chromium, about 1% boron, up to 3% aluminum, and up to 5% silicon.

6. A PDC drag bit body comprising a lower end face having a plurality of pockets for receiving inserts and the body having a composition comprising a refractory compound and an infiltration binder having a dominant composition of iron.

7. The body of claim 6 wherein the refractory compound is a carbide chosen from the group consisting of titanium carbide, tantalum carbide, and tungsten carbide.

8. The body of claim 6 wherein the composition comprises at least 25% binder and at least 50% refractory compound.

9. The body of claim 6 wherein the composition comprises about 40% binder and about 60% refractory compound.

10. The body of claim 6 wherein the binder includes nickel and cobalt.

11. The body of claim 6 wherein the binder further includes at least one refractory metal chosen from the group consisting of titanium, zirconium, hafnium, vanadium, niobium, tantalum, chromium, molybdenum, and tungsten.

12. A PDC drag bit body comprising a lower end face having a plurality of pockets for receiving inserts and the body having a composition comprising a refractory compound and an infiltration binder including at least one alloy chosen from the group consisting of nickel, iron-, and cobalt-base alloys and up to 25% refractory metal.

13. A PDC drag bit body comprising a lower end face having a plurality of pockets for receiving inserts and the body having a composition comprising a refractory compound and an infiltration binder including from 60% to 81% nickel and further includes from 8% to 12% cobalt, from 5% to 10% refractory metal chosen from the group consisting of titanium, zirconium, hafnium, vanadium, niobium, tantalum, chromium, molybdenum, and tungsten, and about 1% boron.

14. A PDC drag bit body comprising a lower end face having a plurality of pockets for receiving inserts and the body having a composition comprising a refractory compound and an infiltration binder including at least 60% nickel and further including from 8% to 12% cobalt, from 5% to 10% chromium, about 1% boron, and up to 3% aluminum.

15. A PDC drag bit comprising a body having a face on a lower end of the body, a plurality of pockets in the face of the body, a plurality of inserts in the pockets, and the body including a refractory compound infiltrated with a binder composition comprising a dominant composition of iron.

16. The bit of claim 15 wherein the binder composition further comprises at least one refractory metal chosen from the group consisting of titanium, zirconium, hafnium, vanadium, niobium, tantalum, chromium, molybdenum, and tungsten.

17. The bit of claim 15 wherein the binder composition further comprises up to 25% refractory metal.

18. The bit of claim 17 wherein the refractory compound comprises at least one refractory metal chosen from the group consisting of titanium, zirconium, hafnium, vanadium, niobium, tantalum, chromium, molybdenum, and tungsten.

19. The bit of claim 17 wherein the binder composition further comprises up to 5% carbon.

20. The bit of claim 15 wherein the binder composition consists essentially of the metal and a refractory metal chosen from the group consisting of titanium, zirconium, hafnium, vanadium, niobium, tantalum, chromium, molybdenum, and tungsten.

21. The bit of claim 15 wherein the binder composition further comprises up to 5% carbon.

22. The bit of claim 15 wherein the binder composition consists essentially of the metal and up to 5% carbon.

23. A method of fabricating a PDC drag bit body comprising the steps of:

fabricating a mold having an inner cavity with a lower end;

introducing a refractory compound into the mold cavity; and infiltrating the refractory compound with a binder alloy having a dominant composition of iron.

24. The method of claim 23 further comprising the step of inserting graphite plugs into the lower end of the cavity for forming pockets in the PDC drag bit body for receiving inserts.

25. The method of claim 24 further comprising the steps of removing the graphite plugs and brazing inserts into the pockets left by the graphite plugs.

26. A method of fabricating a PDC drag bit body comprising the steps of:

fabricating a mold having an inner cavity with a lower end;

coating the inner mold cavity with a protective coating;

introducing a refractory compound into the mold cavity; and infiltrating the refractory compound with a binder alloy composition including a dominant metal chosen from the group consisting of nickel, iron, and cobalt, whereby the protective coating prevents the binder alloy from attacking the mold.

27. The method of claim 26 wherein the protective coating is hexagonal structure boron nitride.

28. A PDC drag bit comprising:

a body formed by introducing a refractory compound into a mold and infiltrating the compound with a binder having a dominant composition of iron; and a plurality of PDC inserts brazed into the body.

* * * * *

UNITED STATES PATENT AND TRADEMARK OFFICE

CERTIFICATE OF CORRECTION

PATENT NO. : 5,662,183
DATED : September 2, 1997
INVENTOR(S) : Zhigang Fang

It is certified that error appears in the above-indentified patent and that said Letters Patent is hereby corrected as shown below:

Column 5, line 24, replace "6 chromium" with -- 60% to 81% nickel, from 8% to 12% cobalt, from 5% to 10% chromium --.
Column 5, line 57, replace "nickel," with -- nickel-, --.

Signed and Sealed this

Eleventh Day of August 1998

Bruce Lehman

*Attest:*

BRUCE LEHMAN

*Attesting Officer*

*Commissioner of Patents and Trademarks*